US005159965A

United States Patent [19]

Roy et al.

[11] Patent Number: 5,159,965

[45] Date of Patent: Nov. 3, 1992

[54] DECORATIVE ARTICLE SUCH AS A CORNICE, VALANCE OR LAMBREQUIN

[76] Inventors: Maria J. Roy, 6323 Merle Pl., Alexandria, Va. 22312; Cornelius B. Cohen, Jr., 3809 13th St., NW., Washington, D.C. 20011

[21] Appl. No.: 588,539

[22] Filed: Sep. 26, 1990

[51] Int. Cl.[5] ..... E06B 9/00

[52] U.S. Cl. ..... 160/38; 160/19

[58] Field of Search ..... 160/38, 39, 348, 330, 160/19; 40/580; D25/55

[56] References Cited

U.S. PATENT DOCUMENTS

| | | | |
|---|---|---|---|
| 2,510,502 | 6/1950 | Kress | 160/38 |
| 2,572,720 | 10/1951 | Goodman | 160/38 |
| 4,221,255 | 9/1980 | Barkemeyer | 160/38 X |

*Primary Examiner*—Blair M. Johnson

*Attorney, Agent, or Firm*—Burns, Doane, Swecker & Mathis

[57] ABSTRACT

A decorative article for interior decorating purposes such as a cornice, lambrequin or valance for an opening forming a door or window in a wall of a building. The article includes a padded board and at least one opening extending therethrough in the shape of a particular object. The board includes a front layer of fabric overlying a compressible pad on the front face thereof. The edges of the board and the opening are covered with suitable decorative trim. An insert can be provided in the opening to simulate a part of the object represented by the opening. In particular, the opening in the board can represent a bow and the insert can represent a knot in the middle of the bow. Ribbons can also be provided extending downwardly from the lower edge of the insert.

19 Claims, 1 Drawing Sheet

Fig. 1
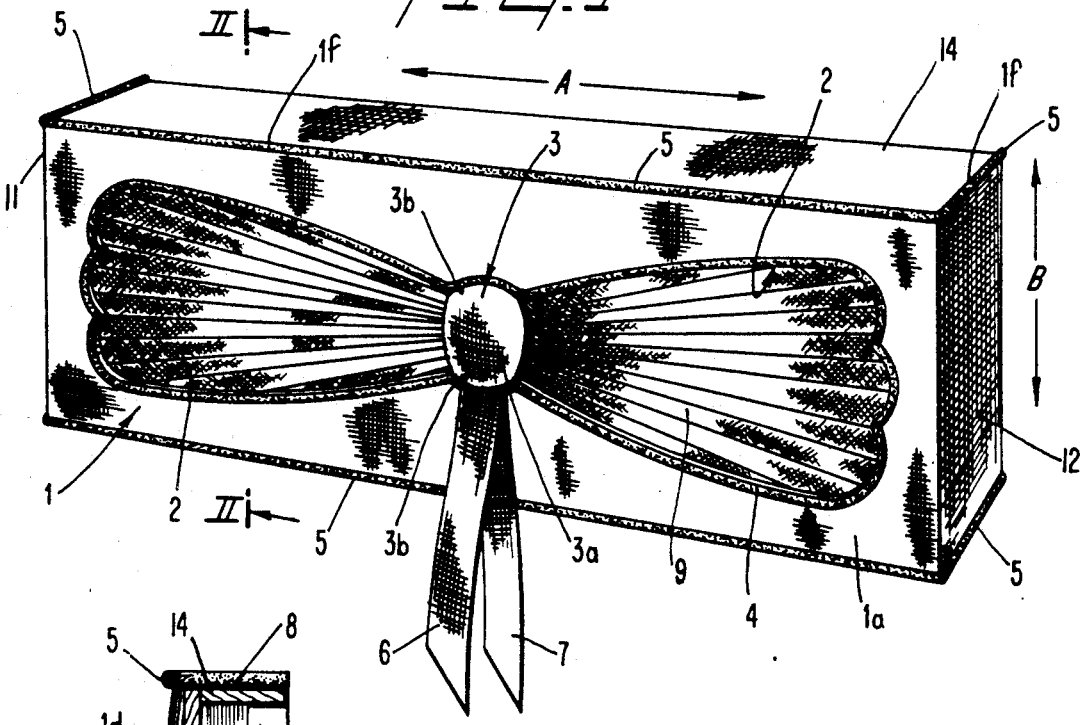
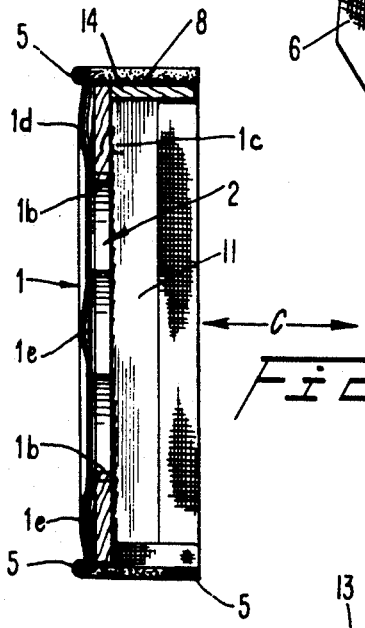
Fig. 2
Fig. 3
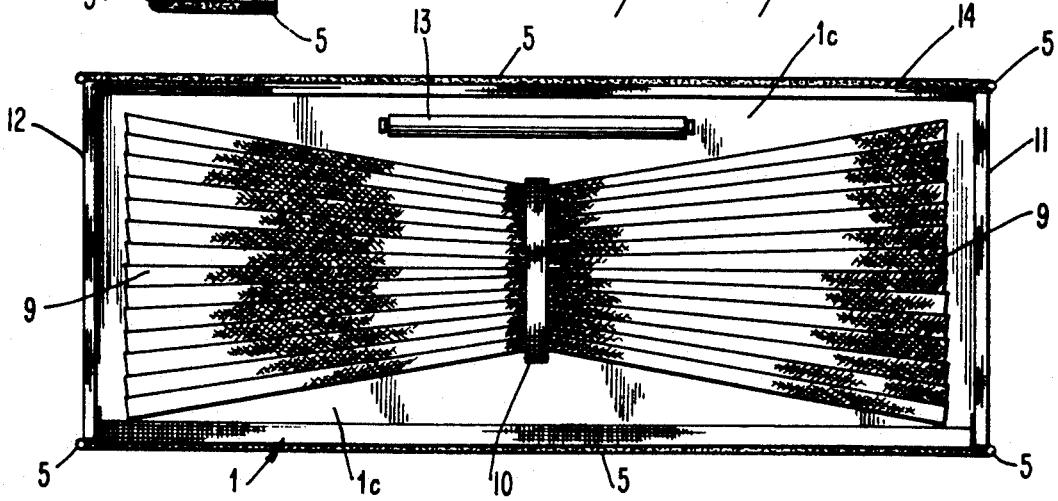

DECORATIVE ARTICLE SUCH AS A CORNICE, VALANCE OR LAMBREQUIN

FIELD OF THE INVENTION

The invention relates to a cornice or similar article which can be used by interior decorators in conjunction with an opening such as a window or a door and which includes a padded board having at least one opening therein with fabric covering a front face of the padded board except in the area of the at least one opening.

BACKGROUND OF THE INVENTION

It is conventional in the art to provide openings in doors or windows of a building with decorative arrangements such as lambrequins or cornices. For instance, U.S. Pat. No. 84,537 (Oberting) discloses a design for a lambrequin in the form of a planar member having cut-outs therein simulating a floral arrangement. U.S. Pat. No. 168,432 (Yellin) discloses a window decorative panel which includes cut-outs therein simulating a scroll type pattern. U.S. Pat. No. 283,284 (Sather, Jr.) discloses a lambrequin which is three-dimensional but which does not include cut-outs. U.S. Pat. No. 169 585 (Goodstein) discloses a sports display cornice unit which includes planar shapes simulating sports equipment. U.S. Pat. No. 150,554 (Cline) discloses a window cornice or similar article which includes illustrations on a planar surface thereof.

U.S. Pat. No. 2,243,222 (Rebholz) discloses a cornice which includes a cornice board of wood or composition material and the face thereof can be painted or bear any suitable design. U.S. Pat. No. 2,708,711 (McGinty et al) discloses an illuminated valance which includes a light mounted behind panel mounting frames in which interchangeable panels can be mounted, the panels comprising glass or plastic or metal or any other suitable material which can be decorated in any desired manner. U.S. Pat. No. 3,297,075 (Howell et al) discloses an arrangement wherein a light can be mounted behind a light cove extrusion having oak slots therein in the area of the light.

U.S. Pat. No. 1,848,618 (Gandolfo et al) discloses an ornamental valance which includes an ornamental central section having points at the top and bottom thereof and end sections extending laterally from either side of the central section, the end sections having a fringed bottom and all of the sections being suitable ornamented or covered with suitable lace or other ornamental material so as to match the curtains in conjunction with which they are used. U.S. Pat. No. 1,933,691 (Young) teaches a drapery fixture for a cornice comprising an ornamental plate constructed as a grill having a series of cut-out portions to provide an ornamental design.

In the field of interior decorating, there is always a demand for new and creative designs. Accordingly, any article which provides a striking three dimensional effect but allows a multitude of design possibilities would be a great success in this highly competitive art.

SUMMARY OF THE INVENTION

An object of the present invention is to provide a decorative arrangement for an opening such as a door or window in a wall of a building. In particular, the inventive arrangement includes a padded board having at least one opening therein, the opening being of a desired shape in accordance with a particular interior designing scheme.

In a preferred embodiment of the invention, the opening in the padded board is in the shape of an easily recognizable object such as a bow or other fanciful design such as a seashell, bird such as a swan, etc. One or more inserts can be provided in the opening as part of the design, such as to simulate a knot of the bow.

The padded board can include a pad on a front face of the board and one or more layers of material covering the pad. The inner edges of the opening can include decorative trim and a layer of material such as fabric or one or more mirrors which can be arranged at angles with respect to each other can be provided on a rear face of the board behind the opening. To provide an added three-dimensional effect, the fabric covering the rear side of the cut-out can be bunched up in one or more places. Similarly to the inner edge of the cut-out, the outer edges of the board can be covered with decorative trim.

BRIEF DESCRIPTION OF THE DRAWINGS

The invention will be described with reference to the accompanying drawings, wherein:

FIG. 1 shows a front perspective view of the inventive arrangement;

FIG. 2 shows a cross section of the arrangement shown in FIG. 1 lines II—II;

FIG. 3 is a rear view of the arrangement shown in FIG. 1.

DETAILED DESCRIPTION OF THE PREFERRED EMBODIMENTS

A decorative article in accordance with a preferred embodiment of the invention is illustrated in FIGS. 1–3. In particular, the decorative article represents a bow which can be mounted in the vicinity of an opening forming a door or window in a wall of a building. However, the decorative article could also be mounted simply on a wall or other location depending on the intended use of the article. For instance, the decorative article could be incorporated in a room divider.

The decorative article according to the preferred embodiment of the invention includes a padded board 1 which has a length extending in a lateral direction A and a width extending in a vertical direction B. At least one opening 2 penetrates the width of the board and extends in a longitudinal direction C through a front face 1*a* of the board 1. The outer edge of the opening 2 is formed by a longitudinally extending surface 1*b* extending between the front face la and a rear face 1*c* of the board 1. The board 1 includes at least one front layer of fabric 1*d* extending over the front face 1*a* without covering the opening 2. Beneath the front layer of fabric 1*d* is a pad 1*e* of compressible material. Such padded boards having a pad of compressible material between an outer layer of fabric and an underlying hard board of wood or other material are commonly used as cornices for draperies in which case the outer layer of fabric usually matches that used for the drapery and/or upholstery material used in a room design.

In accordance with the invention, at least one insert 3 can be supported within the opening 2. In the case of the bow illustrated in FIG. 1, the insert 3 can simulate a knot at the center of the bow. However, such inserts could be used for creating other designs than that shown in FIG. 1. The insert 3 shown in FIG. 1 includes at least one layer of fabric 3*a* on a front surface thereof.

The front surface of the insert 3 can be flat or 3-dimensional and extends in the transverse and vertical directions A and B, respectively. The insert also faces in the same direction that the front face 1*a* of the board 1 faces. The front surface of the insert 3 can be coplanar with the front surface 1*a* of the board or the front surface of the insert 3 can be located in front of the front face 1*a* or recessed from the front face 1*a*.

In the embodiment shown in FIG. 1, the insert 3 includes at least one outer edge 3*b* extending in the longitudinal direction C rearwardly from the front surface of the insert, the edge 3*b* being closely fitted to a portion of the edge of the opening 2. As shown in FIG. 1, the insert 3 can include two such edges 3*b* which are closely fitted to opposed portions of the longitudinally extending surface 1*b* of the board 1.

The inwardly facing surface 1*b* can include decorative trim 4, such trim including a welt cord covered by fabric and the welt cord extending along the front face 1*a* of the board 1 and the fabric can either be shirred or non-shirred. Likewise, decorative trim 5 can be provided on the outer edges 1*f* of the board 1. Again, the decorative trim 5 can include a welt cord covered by fabric with the welt cord extending along the front face 1*a* of the board. Furthermore, as shown in FIG. 2, the decorative trim 5 can include fabric 8 which extends completely around the outer edges and partly over the rear surface 1*c* of the board 1. Likewise, the decorative trim 4 can extend completely around the inner surface 1*b* forming the opening 2. The decorative trim 4 advantageously covers staples used to hold the fabric 1*d* in a smooth, unwrinkled state on the front of the board 1. Depending on the complexity of the shape of the cutout 2, the fabric 1*d* can be cut and stapled close to the outer edge of the opening 2 and still provide a smooth appearance over the front face of the board.

To further simulate a bow, ribbons 6, 7 can be provided such that they extend from the lower edge of the insert 3 as shown in FIG. 1. The opening 2 can be left open or at least one rear layer of fabric 9 can extend across the opening 2 on the rear face 1*c* of the board 1. Accordingly, the opening 2 can be transparent or can be made translucent or opaque by the provision of the rear layer of fabric 9. If the opening is to be made opaque, other materials besides fabric can be used to cover the opening 2. Likewise, if the opening 2 is to be transparent or translucent, a material other than fabric can be used to cover the rear of the opening 2, such materials including glass, plastic or other such materials which can be clear, various colors, or any desired ornamentation can be added thereto.

The rear layer of fabric 9 can be bunched or gathered to create an aesthetically pleasing appearance. For instance, in the case of the bow illustrated in FIG. 1, the rear layer of fabric 9 can include means 10 for gathering the rear layer of fabric 9 along at least one direction. For instance, the gathering means 10 can comprise shirring or an elastic tape attached to the rear layer of fabric 9 in a stretched condition, the elastic tape forming the bunched up portions when the elastic tape is in an unstretched condition. If shirring is used, a cord or string can be placed on the fabric 9 and a lockstitch sewn thereover by means of a serger such that the cord or string underlies the lockstitch whereby the fabric 9 can be bunched by knotting one end of the string and pulling the string to bunch up the fabric. An advantage of this arrangement is that it does not curl as in the case of shirring tape which tends to curl when the fabric is bunched up. Thus, when the rear layer of fabric 9 is mounted on the rear face 1*c* of the board 1 as illustrated in FIG. 3, the shirring or the elastic tape in the unstretched condition causes the fabric to be bunched up in the vertical direction B. The material 9 can also be bunched up at opposite lateral ends thereof. In this case, additional gathering means can be used or the fabric can simply be overlapped and stapled or otherwise secured to the rear face 1*c* of the board 1.

In another embodiment, the board 1 can include lighting means 13 which is mounted behind the rear face 1*c* of the board 1 for providing light which passes through the opening 2. Such an arrangement provides an aesthetically pleasing effect when the rear layer of fabric 9 is provided.

For purposes of mounting the board 1, the board 1 can include side pieces 11, 12 comprising returns and/or a roof 14 which is flush or recessed with the top of the board for spacing the board 1 longitudinally from a surface on which the board is mounted. The side pieces 11, 12 can be attached to such a surface by suitable means such as brackets.

The invention offers many possibilities for the designer. For instance, in the case of cornices, the upper edges and the bottom edges can include a desired shape. Furthermore, a plurality of openings 2 can be provided in the board 1 to provide a pattern of easily recognizable objects constituting original art. In addition, the cornice in accordance with the invention can include suitable means for supporting drapery rods and can be used to conceal drapery pleats. The opening or openings can be shaped to simulate objects such as a butterfly, various flowers such as tulips or sunflowers, a sunburst, a seashell or a multitude of other designs. In addition, by manipulating the rear layer of fabric which covers the rear face of the board, it is possible to simulate the texture of the object represented by the opening or openings. For instance, by gathering the rear layer of fabric 9 or by using different types of fabric or other material for the rear layer of fabric 9, it is possible to simulate the texture of the bow material shown in FIG. 1 or to simulate such features as leaves of a flower, petals of a flower, etc. Furthermore, as shown in FIG. 1, additional effects can be obtained by mounting pieces of material or objects on the front face 1*a* of the board 1.

While the invention has been described with reference to the foregoing embodiments, changes and variations may be made thereto which fall within the scope of the appended claims.

What is claimed is:

1. A decorative article which can be used, for instance, to decorate an opening forming a door or window in a wall of a building, the article comprising a padded board and at least one opening extending through a front face of the padded board, the opening being formed by an inner edge surface extending between the front face and a rear face of the padded board, the padded board having at least one front layer of fabric extending over the front face without covering the opening, and at least one insert supported within the opening, the insert having at least one layer of fabric which faces in a direction extending from the rear face toward the front face of the padded board.

2. The article of claim 1, further comprising lighting means mounted behind the rear face of the padded board for providing light which passes through the opening.

3. The article of claim 1, wherein the article comprises a cornice.

4. The article of claim 1, wherein the article comprises a lambrequin.

5. The article of claim 1, wherein the padded board includes a pad of compressible material between the front layer of fabric and the front face of the board.

6. The article of claim 1, wherein the insert includes at least one outer edge closely fitted to the inner edge surface of the board.

7. The article of claim 1, wherein the fabric on the front surface of the insert also covers the outer edge of the insert.

8. A decorative article which can be used, for instance, to decorate an opening forming a door or window in a wall of a building, the article comprising a padded board and at least one opening extending through a front face of the padded board, the opening being formed by an inner edge surface extending between the front face and a rear face of the padded board, the padded board having at least one front layer of fabric extending over the front face without covering the opening, and at least one rear layer of fabric extending across the opening on the rear face of the padded board.

9. The article of claim 8, wherein the rear layer of fabric on the rear face of the padded board includes means for gathering the rear layer of fabric along at least one direction, the rear layer of fabric being supported on the rear face of the padded board with bunched up portions thereof formed by the gathering means.

10. The article of claim 9, wherein the gathering means comprises an elastic tape attached to the rear layer of fabric in a stretched condition, the elastic tape forming the bunched up portions when the elastic tape is in an unstretched condition, the rear layer of fabric being mounted on the rear face of the padded board with the elastic tape in the unstretched condition.

11. The article of claim 1, wherein at least one outer edge of the padded board is covered with decorative trim.

12. The article of claim 11, wherein the decorative trim includes a welt cord covered by fabric and the welt cord extends along the front face of the padded board.

13. A decorative article which can be used, for instance, to decorate an opening forming a door or window in a wall of a building, the article comprising a padded board and at least one opening extending through a front face of the padded board, the opening being formed by an inner edge surface extending between the front face and a rear face of the padded board, the padded board having at least one front layer of fabric extending over the front face and being attached to said inner edge without covering the opening, and the fabric covered inner edge surface in the padded board being covered with a discrete decorative trim.

14. The article of claim 13, wherein the decorative trim includes a welt cord covered by fabric and the welt cord extends along the front face of the padded board.

15. The article of claim 8, wherein the rear layer of fabric is opaque.

16. The article of claim 8, wherein the rear layer is translucent.

17. The article of claim 16, further comprising lighting means mounted behind the rear face of the padded board for providing light which passes through the opening.

18. The article of claim 3, further comprising means for mounting the board on a wall, said mounting means comprising returns.

19. The article of claim 3, further comprising means for mounting the board on a wall, said mounting means comprising a roof.

* * * * *